US008246768B2

(12) United States Patent
Hoshino et al.

(10) Patent No.: US 8,246,768 B2
(45) Date of Patent: Aug. 21, 2012

(54) HIGH-TENSILE STEEL PLATE OF LOW ACOUSTIC ANISOTROPY AND HIGH WELDABILITY HAVING YIELD STRESS OF 450 MPA OR GREATER AND TENSILE STRENGTH OF 570 MPA OR GREATER, AND PROCESS FOR PRODUCING THE SAME

(75) Inventors: Manabu Hoshino, Futtsu (JP); Masaaki Fujioka, Futtsu (JP); Yoichi Tanaka, Futtsu (JP); Tatsuya Kumagai, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/084,502

(22) PCT Filed: Nov. 8, 2006

(86) PCT No.: PCT/JP2006/322683

§ 371 (c)(1),
(2), (4) Date: May 1, 2008

(87) PCT Pub. No.: WO2007/055387

PCT Pub. Date: May 18, 2007

(65) Prior Publication Data

US 2009/0107591 A1 Apr. 30, 2009

(30) Foreign Application Priority Data

Nov. 9, 2005 (JP) ..... 2005-324798
Nov. 7, 2006 (JP) ..... 2006-301540

(51) Int. Cl.
*C21D 8/02* (2006.01)
*C22C 38/04* (2006.01)

(52) U.S. Cl. ..... 148/645; 148/337

(58) Field of Classification Search ..... 148/335, 148/593, 645, 337
See application file for complete search history.

(56) References Cited

U.S. PATENT DOCUMENTS 6,319,338 B1 * 11/2001 Kawano et al. ..... 148/328
(Continued)

FOREIGN PATENT DOCUMENTS

EP 1 026 275 8/2000
(Continued)

OTHER PUBLICATIONS

International Standard ISO 6929, Steel products—Definitions and classification—First Edition, Oct. 15, 1987, pp. 1, 2, 11, 12, 15 and 16.

(Continued)

*Primary Examiner* — Jessica L Ward
*Assistant Examiner* — Alexander Polyansky
(74) *Attorney, Agent, or Firm* — Kenyon & Kenyon LLP

(57) ABSTRACT

A high-tensile steel plate of low acoustic anisotropy and high weldability having yield stress of 450 MPa or greater and tensile strength of 570 MPa or greater and a process for producing the steel plate are provided. The steel has an Si content of 0.10% or less, thereby achieving a volume ratio of island martensite of 3% or less, contains Nb≧0.025% and Ti≧0.005% so as to satisfy 0.045%≦[Nb]+2×[Ti]≦0.105%, contains Nb, Ti, C and N in ranges such that the value of A=([Nb]+2×[Ti])×([C]+[N]×12/14) is 0.0022 to 0.0055, and has a steel structure wherein bainite volume ratio is 30% or more and pearlite volume ratio is less than 5%.

8 Claims, 2 Drawing Sheets

U.S. PATENT DOCUMENTS

| | | | | |
|---|---|---|---|---|
| 2004/0187982 | A1 * | 9/2004 | Nakata et al. | 148/653 |

FOREIGN PATENT DOCUMENTS

| | | | | |
|---|---|---|---|---|
| EP | 1 493 828 | | | 1/2005 |
| GB | 2 019 439 | | | 10/1979 |
| JP | 52-081014 | A | | 7/1977 |
| JP | 53-119219 | A | | 10/1978 |
| JP | 54-021917 | A | | 2/1979 |
| JP | 54-071714 | A | | 6/1979 |
| JP | 58-100625 | | | 6/1983 |
| JP | 63-033521 | A | | 2/1988 |
| JP | 1-149923 | A | | 6/1989 |
| JP | 02-205627 | A | | 8/1990 |
| JP | 09235617 | | * | 9/1997 |
| JP | 2000-109947 | | | 4/2000 |
| JP | 2000-219934 | A | | 8/2000 |
| JP | 2000-256777 | A | | 9/2000 |
| JP | 2001-064723 | A | | 3/2001 |
| JP | 2001-064728 | A | | 3/2001 |
| JP | 2001073071 | A | * | 3/2001 |
| JP | 2001-152248 | | | 6/2001 |
| JP | 2001-200334 | | * | 7/2001 |
| JP | 2002-053912 | A | | 2/2002 |
| JP | 2002-088413 | A | | 3/2002 |
| JP | 2002-105590 | A | | 4/2002 |
| JP | 2005-126819 | A | | 5/2005 |
| WO | WO 99/05335 | | | 2/1999 |
| WO | WO 2004/111286 | | | 12/2004 |

OTHER PUBLICATIONS

European Search Report dated May 14, 2012 issued in corresponding European Application No. 06 823 385.7.

* cited by examiner

HIGH-TENSILE STEEL PLATE OF LOW ACOUSTIC ANISOTROPY AND HIGH WELDABILITY HAVING YIELD STRESS OF 450 MPA OR GREATER AND TENSILE STRENGTH OF 570 MPA OR GREATER, AND PROCESS FOR PRODUCING THE SAME

FIELD OF THE INVENTION

This invention relates to a high-tensile steel plate of low acoustic anisotropy and high weldability having yield stress of 450 MPa or greater and tensile strength of 570 MPa or greater, and a process for producing the steel plate that enables production with high productivity without need for offline heat treatment. The invention steel plate is used in the form of thick steel plate in the structural members of welded structures such as bridges, ships, buildings, marine structures, pressure vessels, penstocks, line pipes and the like.

DESCRIPTION OF THE RELATED ART

The high-tensile steel plates in the 570 MPa tensile strength class and upward intended for use in the structural members of welded structures such as bridges, ships, buildings, marine structures, pressure vessels, penstocks, line pipes and the like need to excel not only in strength but also in toughness and weldability, and particularly, have also in recent years been increasingly required to offer good weldability under high heat input. Efforts to improve the properties of the plates have continued over many years.

Technologies related to the composition and production conditions of such steel plates are taught, for example, by Japanese Patent Publication (A) Nos. S53-119219 and H01-149923. In the methods used to produce these steel plates, rolling is followed by offline heat treatment that involves reheating-hardening, plus additional reheating (tempering). Further, Japanese Patent Publication (A) Nos. S52-081014, S63-033521 and H02-205627, for example, set out inventions related to production by so-called direct hardening, in which the steel plate is hardened online after rolling. In both the case of reheating-hardening and the case of direct hardening, offline tempering heat treatment is necessary. In order to increase productivity, however, it is preferable to use a so-called as-rolled production process that also omits tempering heat treatment and does not require offline heat treatment.

A number of as-rolled production process inventions have been published, including, for example, those taught by Japanese Patent Publication (A) Nos. S54-021917, S54-071714, 2001-064723 and 2001-064728. These relate to the interrupted accelerated cooling process in which accelerated cooling of after rolling is terminated midway. This process is aimed at eliminating reheating (tempering) by using accelerated cooling to rapidly cool to below the transformation temperature and thereby obtain a hardened steel structure and then, while the post-transformation temperature is till relatively high, terminating the water cooling to shift to slow cooling and realize the tempering effect of the slow cooling.

Moreover, the invention taught by Japanese Patent Publication (A) No. 2002-088413 relates to use of the interrupted accelerated cooling process to manufacture a high-tensile steel plate with tensile strength in the 570 MPa class or higher.

Further, Japanese Patent Publication (A) No. 2002-0539912 teaches an invention relating to an as-rolled process that also omits water cooling after rolling.

In addition, Japanese Patent Publication (A) No. 2005-126819 teaches an invention relating to a method of using the interrupted accelerated cooling process to produce a high-tensile steel plate that has tensile strength in the 570 MPa class or higher and is low in acoustic anisotropy and excellent in weldability.

SUMMARY OF THE INVENTION

However, the inventions taught by the aforesaid Japanese Patent Publication (A) Nos. S53-119219, H01-149923, S52-081014, S63-033521 and H02-205627 are inevitably inferior in productivity owing to the need for offline heat treatment.

Although the inventions of the aforesaid Japanese Patent Publication (A) Nos. S54-021917, S54-071714, 2001-064723 and 2001-064728 attempt to overcome the low productivity issue by utilizing the as-rolled production process that eliminates the need for offline heat treatment by omitting tempering heat treatment, even they cannot be said to achieve high productivity owing to the fact that the controlled rolling at a relatively low temperature they require to achieve toughness and strength involves a temperature wait time because the rolling finish temperature is around 800° C. Moreover, particularly in an application where the product is to be used in a bridge, building or the like, the acoustic anisotropy must be minimized because of its adverse effect on the accuracy of ultrasonic angle beam testing of welds. However, since the controlled rolling with a finish temperature of around 800° C. forms a texture, the acoustic anisotropy of the steel plate is large, so that these prior art technologies are not always suitable for such applications.

The invention set out in the aforesaid Japanese Patent Publication (A) No. 2002-088413 asserts that V contributes to precipitation hardening even at the slow cooling stage after accelerated cooling interruption. But, as explained further later, the inventors' studies found that the V precipitation rate is slower than that of Nb and Ti at the slow cooling stage after accelerated cooling interruption. The inventors thus-learned that V is not so effective for steel hardening and concluded that the composition proposed by the invention does not necessarily ensure consistent strength.

The invention of the aforesaid Japanese Patent Publication (A) No. 2002-0539912 does not experience large acoustic anisotropy because it does not conduct controlled rolling at a low temperature. As a tradeoff, however, it has a problem of poor economy owing to, for example, the addition of large amounts of alloying elements, like Cu, Ni and Mn, in order to secure strength.

The invention of the foregoing Japanese Patent Publication (A) No. 2005-126819 ('819) was accomplished by the present inventors. The '819 invention makes it possible to produce a high-tensile steel plate that has tensile strength in the 570 MPa class or higher and is low in acoustic anisotropy and high in weldability by utilizing a production process premised on use of an economical composition low in alloying elements in combination with the high-productivity interrupted accelerated cooling process. However, further research showed that in the case of thick steel having a plate thickness of 30 to 100 mm, the '819 invention is not always capable of achieving the desired yield stress of 450 MPa or greater, particularly at the center of the plate in the thickness direction. The original yield strengths and tensile strengths of the examples shown in Tables 3 and 4 of '819 were results obtained by the inventors through tensile tests carried out on tensile test pieces sampled at the ¼ plate thickness region (¼ t region). However, the steel plate of the present invention is intended for use in the form of thick steel plate in structural members of welded structures such as bridges, ships, buildings, marine structures, pressure vessels, penstocks, line pipes and the like. As such, it is of course desirable for it to have yield stress of 450 MPa or greater not only at the ¼ t region but also at the thickness center region.

The object of the present invention is therefore to provide a high-tensile steel plate of low acoustic anisotropy and high weldability having yield stress of 450 MPa or greater and tensile strength of 570 MPa or greater, inclusive of at the plate thickness center region of a thick steel having a plate thickness of 30 to 100 mm, which high-tensile steel plate is premised on use of an economical composition low in alloying elements in combination with the high-productivity interrupted accelerated cooling process, and a process for producing the steel plate. It should be noted that the present invention is not limited to steel plates having a thickness of 30 mm or larger but covers steel plates produced by the steel plate production process falling in the range of 6 mm to 100 mm.

The present invention is an improvement invention based on the invention set out in '819 that further focuses on the yield stress at the thickness center of a thick steel. The background of the present invention will therefore be explained in the following with reference to the background of the invention of '819 where appropriate.

Although a number of means are available for strengthening high-tensile steel, the method of utilizing the precipitation hardening effect of Nb, V, Ti, Mo and Cr carbides, nitrides and the like enables strengthening with a relatively small amount of alloying components. When this method is used, it is important for achieving abundant precipitation hardening to form precipitates that are coherent with the matrix.

In the interrupted accelerated cooling process conducted after rolling, the accelerated cooling transforms the austenitic steel structure at the time of rolling to a bainite, ferrite or other such ferritic matrix structure. After the transformation, the precipitates that precipitated in the austenite from before the rolling or the accelerated cooling lose their coherency with the matrix and are reduced in strengthening effect. Moreover, precipitates that precipitate at an early stage of the rolling enlarge and degrade toughness. This makes it important to suppress precipitation of precipitates during rolling and before accelerated cooling and to maximize precipitation in the bainitic or ferritic structure in the stage of the slow cooling following termination of the accelerated cooling. In the conventional thermal refining process of conducting reheating (tempering) treatment after water cooling, considerable precipitation hardening can be achieved owing to the ease of obtaining the temperature and time for the precipitation. In contrast, the interrupted accelerated cooling process, which does not conduct reheating (tempering), is generally disadvantageous from the viewpoint of precipitation hardening because, notwithstanding that precipitation can be expected during the slow cooling following termination of accelerated cooling, the temperature and time for precipitation are both restricted owing to the fact that the accelerated cooling termination temperature has to be kept somewhat low in order to achieve a hardened structure. As explained earlier, these circumstances mean that while the as-rolled process is high in productivity, it cannot achieve the same strength as the conventional thermal refining process other than by abundant use of alloying elements or conducting controlled rolling at a low temperature.

The inventors therefore carried out an extensive study in search of a method that, while premised on the high-productivity interrupted accelerated cooling process, is capable of achieving high strength without heavy addition of alloying elements or low-temperature controlled rolling, particularly such a method that exploits precipitation hardening to the utmost.

First, in order to ascertain the precipitation behavior in the slow cooling process following accelerated cooling termination, they carried out a detailed investigation into how the precipitation rate of the carbides, nitrides and carbonitrides of individual alloying elements in bainitic or ferritic structure or a mixed structure thereof and the precipitation hardening amount are related to temperature and holding time. As a result, they learned that in bainitic or ferritic structure or a mixed structure thereof, Nb carbonitride and Ti carbide precipitate at a faster precipitation rate than V and other elements, that they produce large hardening amount because they are coherent with the matrix, and that their precipitation rate is high and hardening amount is large particularly in the 600° C. to 700° C. temperature range. In addition, the inventors learned that when Nb and Ti, or Nb, Ti and Mo, are used together and precipitated in combination, a synergistic effect is produced that achieves large precipitation hardening by enabling fine dispersion of precipitates coherent with the matrix even with short holding time.

However, when the amounts of Nb and Ti added are excessive, the precipitates tend to coarsen to make the number of precipitates smaller rather than larger, whereby the precipitation hardening amount decreases. Moreover, the precipitation rate and the morphology of the Nb and Ti carbide, nitride and carbonitride precipitates in the austenite or ferrite is greatly affected by the amounts of Nb and Ti added and the amounts of C and N. By conducting various experiments and analyses, the inventors learned that the precipitation rates and morphologies of the Nb and Ti carbides, nitrides and carbonitrides can be neatly expressed by Parameter $A=([Nb]+2\times[Ti])\times([C]+[N]\times 12/14)$ and that by controlling this value to within a certain range, it is possible suppress precipitation during rolling while adequately achieving fine precipitation during slow cooling after terminating water cooling midway. In other words, the amounts of C and N added need to be reduced in proportion as the amounts of Nb and Ti added are larger. When the value of A is too small, the precipitation rate in the ferrite is slow and adequate precipitation hardening cannot be achieved. When the value of A is too large, the precipitation rate of carbides, nitrides and carbonitrides in the austenite is too fast, which causes the precipitates to coarsen and makes the coherent precipitation amount during the slow cooling following accelerated cooling termination deficient, so that the precipitation hardening amount is also low in this case.

The steel structure also strongly affects these precipitation hardening effects. A bainitic structure maintains dislocation density and other worked structures better than ferrite does. The presence of abundant dislocations, deformation bands and other precipitation sites in the worked structures is highly effective for promoting fine coherent precipitation. A study conducted by the inventors showed that for achieving sufficient strength it is necessary to establish a bainite single phase or a mixed structure of bainite and ferrite comprising 30% or more of bainite by volume. When pearlite is present, Nb and Ti carbides, nitrides and carbonitrides precipitate at the pearlite phase boundary to diminish the desired hardening effect, so that not only does it become difficult to achieve a tensile strength of 570 MPa but toughness and the like are also diminished. Although pearlite therefore must be reduced to the utmost possible, these adverse effects are minimal at a content of less than 5% by volume, so this is the allowable range.

The inventors next conducted a study regarding specific production conditions for obtaining maximum precipitation hardening effect. Their findings were as follows.

The present invention imparts strength by taking utmost advantage of precipitation hardening by Nb, Ti and the like in the interrupted accelerated cooling process following rolling and therefore requires Nb and Ti to be sufficiently dissolved in solid solution the during heating of the billet or slab before rolling. However, it was found that Nb and Ti tend to dissolve less readily during heating when co-present than when independently present, so that they do not necessarily thoroughly dissolve under heating at the solution temperature anticipated from their respective solubility products and the like. The inventors investigated the heating temperature and Nb and Ti solid solution states of the invention steel and made a detailed analysis particularly of the relationship between the aforesaid A value and the Nb and Ti solid solution states. As a result, they reached the conclusion that Nb and Ti can be thoroughly dissolved by making the heating temperature of the billet or slab higher than the temperature T (° C.) calculated by the following conditional expression including the A value:

$$T=6300/(1.9-\text{Log}\,A)-273,$$

where A=([Nb]+2×[Ti])×([C]+[N]×12/14) and [Nb], [Ti], [C] and [N] represent the contents of Nb, Ti, C and N expressed in mass %.

Log A is a common logarithm.

Nb and Ti precipitation at the rolling stage is promoted by the rolling strain, while the rolling conditions in the austenite high-temperature region, the so-called roughing conditions, markedly affect the final precipitation hardening effect. Specifically, the requirements for suppressing precipitation during rolling are to finish roughing in the temperature range of 1020° C. or higher and to avoid rolling in the temperature range lower than 1020° C. and higher than 920° C. as much as possible. However, if all rolling should be finished in the temperature range of 1020° C. or higher, the recovery and recrystallization would leave almost no worked structures after interrupted accelerated cooling, so that adequate precipitation hardening would be impossible owing to the presence of too few dislocations, deformation bands and other precipitation sites. An essential condition is, therefore, to conduct necessary and sufficient rolling in the un-recrystallized region and to conduct accelerated cooling immediately after the rolling. Specifically, relatively light rolling of a total reduction of 20 to 50% is conducted in a limited range between 920° C. and 860° C. As the rolling strain does not become excessively large under this condition, unnecessary Nb and Ti precipitation is inhibited and a strong texture is not formed. Acoustic anisotropy therefore also does not become large. In addition, the required amount of rolling strain can be secured because sufficient precipitation sites remain even after accelerated cooling termination.

The accelerated cooling termination temperature of the interrupted accelerated cooling process is made 600 to 700° C. to facilitate Nb and Ti precipitation, but in order to obtain a steel structure comprising 30% or more of bainite by volume even at such a high termination temperature, the composition of the steel is limited to the specific range set out below and the cooling rate in the accelerated cooling is required to be between 2° C./sec and 30° C./sec.

The knowledge acquired by the inventors offers a fresh approach in which precipitation of Nb and Ti carbides and carbonitrides is controlled online from during rolling, including rolling in the high-temperature region, through accelerated cooling and slow cooling following termination of accelerated cooling, whereby precipitation hardening on a par with or superior to that by the conventional thermal refining process is achieved by the interrupted accelerated cooling process without need for offline heat treatment.

Further, according to this production process, the weld cracking parameter for steel composition Pcm (Pcm=[C]+[Si]/30+[Mn]/20+[Cu]/20+[Ni]/60+[Cr]/20+[Mo]/15+[V]/10+5[B], where [C], [Si], [Mn], [Cu], [Ni], [Cr], [Mo], [V] and [B] represent the contents of C, Si, Mn, Cu, Ni, Cr, Mo, V and B expressed in mass %) can be held low, i.e., Pcm≦0.18, to provide a high-tensile steel with tensile strength in the 570 MPa class or higher that has excellent weldability characterized by high weld heat-affected zone toughness even at large heat input.

The inventors next conducted a study regarding the problem experienced by the invention of '819 of a decline in yield stress at the thickness center region of thick steel on the order of 30 to 100 mm thickness. They produced steels of the compositions shown in Table 1, processed the obtained slab into 50-mm thick plates under the production conditions shown in Table 2, sampled test pieces at the ¼ thickness region (¼ t region) and center thickness region (½ t), and measured their yield stress and tensile strength in conformity with the method of JIS Z 2241 using No. 4 rod tensile test pieces in conformity with JIS Z 2201. The results are shown in Table 2.

TABLE 1

| | Chemical composition (Mass %) | | | | | | | | | | | | |
|---|---|---|---|---|---|---|---|---|---|---|---|---|---|
| Steel | C | Si | Mn | P | S | Mo | Al | Nb | Ti | Nb + 2Ti | A** | N | Pcm* |
| W | 0.06 | 0.18 | 1.74 | 0.013 | 0.016 | 0.13 | 0.057 | 0.032 | 0.020 | 0.072 | 0.0046 | 0.0044 | 0.162 |
| X | 0.06 | 0.38 | 1.16 | 0.005 | 0.014 | 0.06 | 0.019 | 0.063 | 0.007 | 0.077 | 0.0050 | 0.0050 | 0.135 |

*Pcm = C + Si/30 + Mn/20 + Cu/20 + Ni/60 + Cr/20 + Mo/15 + V/10 + 5B

**A = (Nb + 2 Ti) × (C + N × 12/14)

TABLE 2

| Production conditions | | Heating temp at rolling | T* | Total reduction <1020° C.~>920° C. | Total reduction 920° C.~860° C. | Cooling rate | Accelerated cooling end temp | Plate thickness | Bainite vol ratio | Pearlite vol ratio | Island martensite vol ratio | Yield stress (MPa) | | Tensile strength (MPa) | |
|---|---|---|---|---|---|---|---|---|---|---|---|---|---|---|---|
| No. | Steel | (° C.) | (° C.) | (%) | (%) | (° C./sec) | (° C.) | (mm) | (%) | (%) | (%) | ¼ t | ½ t | ¼ t | ½ t |
| 23 | W | 1230 | 1214 | 0 | 39 | 9 | 610 | 50 | 40 | 4 | 3 | 495 | 410 | 635 | 621 |
| 24 | X | 1250 | 1225 | 0 | 39 | 10 | 620 | 50 | 78 | <1 | 5 | 489 | 408 | 615 | 605 |

TABLE 2-continued

| Production conditions No. | Steel | Heating temp at rolling (° C.) | T* (° C.) | Total reduction <1020° C.~>920° C. (%) | Total reduction 920° C.~860° C. (%) | Cooling rate (° C./sec) | Accelerated cooling end temp (° C.) | Plate thickness (mm) | Bainite vol ratio (%) | Pearlite vol ratio (%) | Island martensite vol ratio (%) | Yield stress (MPa) ¼ t | Yield stress (MPa) ½ t | Tensile strength (MPa) ¼ t | Tensile strength (MPa) ½ t |
|---|---|---|---|---|---|---|---|---|---|---|---|---|---|---|---|

*T = 6300/(1.9 − LogA) − 273; A = (Nb + 2 Ti) × (C + N × 12/14)

It can be seen from Table 2 that yield stress and tensile strength at the ¼ t region and tensile strength at the ½ t region met the desired values but that yield stress was low at the thickness center region and did not achieve the desired value of 450 MPa. The inventors conducted an in-depth study regarding the reason for this result and learned that island martensite formed at the thickness center region lowered the yield stress of this region and further that in the case of the combination of composition and production process set out in '819, island martensite readily formed at the thickness center region of thick steel of a plate thickness of around 30 to 100 mm.

The inventors therefore investigated the effect of island martensite on yield stress (upper yield point or 0.2% proof stress). They first produced steels of the compositions shown in Table 3, processed the obtained slab into 50-mm thick plates under the production conditions shown in Table 4, and calculated the volume ratios of island martensite at the thickness center regions (½ t regions) based on observation of 10 fields within a range of 100 mm×100 mm using 500× structure micrographs. They further sampled test pieces at the ½ t regions of the test plates, and measured their yield stress in conformity with the method of JIS Z 2241 using No. 4 rod tensile test pieces in conformity with JIS Z 2201. The results are shown in Table 4 and FIG. 1.

TABLE 3

| Steel | C | Si | Mn | P | S | Al | Nb | Ti | Nb + 2Ti | A** | N | Pcm* |
|---|---|---|---|---|---|---|---|---|---|---|---|---|
| S1 | 0.07 | 0.00 | 1.86 | 0.016 | 0.003 | 0.035 | 0.045 | 0.014 | 0.073 | 0.0053 | 0.0025 | 0.163 |
| S2 | 0.07 | 0.03 | 1.86 | 0.015 | 0.007 | 0.031 | 0.040 | 0.013 | 0.066 | 0.0047 | 0.0035 | 0.162 |
| S3 | 0.07 | 0.05 | 1.82 | 0.013 | 0.006 | 0.036 | 0.042 | 0.012 | 0.066 | 0.0045 | 0.0034 | 0.158 |
| S4 | 0.07 | 0.07 | 1.85 | 0.016 | 0.005 | 0.027 | 0.046 | 0.014 | 0.074 | 0.0054 | 0.0028 | 0.165 |
| S5 | 0.06 | 0.09 | 1.87 | 0.014 | 0.004 | 0.024 | 0.038 | 0.009 | 0.056 | 0.0036 | 0.0043 | 0.157 |
| S6 | 0.07 | 0.12 | 1.68 | 0.015 | 0.006 | 0.023 | 0.050 | 0.013 | 0.076 | 0.0053 | 0.0032 | 0.155 |
| S7 | 0.06 | 0.23 | 1.90 | 0.015 | 0.005 | 0.020 | 0.038 | 0.011 | 0.060 | 0.0038 | 0.0040 | 0.163 |
| S8 | 0.07 | 0.27 | 1.86 | 0.012 | 0.004 | 0.039 | 0.045 | 0.012 | 0.069 | 0.0050 | 0.0036 | 0.171 |
| S9 | 0.06 | 0.35 | 1.92 | 0.012 | 0.005 | 0.024 | 0.042 | 0.010 | 0.062 | 0.0041 | 0.0029 | 0.171 |
| S10 | 0.06 | 0.42 | 1.75 | 0.010 | 0.002 | 0.034 | 0.039 | 0.009 | 0.057 | 0.0036 | 0.0037 | 0.162 |

*Pcm = C + Si/30 + Mn/20 + Cu/20 + Ni/60 + Cr/20 + Mo/15 + V/10 + 5B

**A = (Nb + 2 Ti) × (C + N x 12/14)

TABLE 4

| Steel | Heating temp at rolling (° C.) | T* (° C.) | Total reduction <1020° C.~>920° C. (%) | Total reduction 920° C.~860° C. (%) | Cooling rate (° C./sec) | Accelerated cooling end temp (° C.) | Plate thickness (mm) | Island martensite vol ratio (%) | Yield stress ½ t (MPa) |
|---|---|---|---|---|---|---|---|---|---|
| S1 | 1260 | 1235 | 0 | 35 | 10 | 620 | 50 | 0.0 | 536 |
| S2 | 1250 | 1217 | 0 | 34 | 10 | 630 | 50 | 0.3 | 532 |
| S3 | 1260 | 1210 | 0 | 38 | 10 | 630 | 50 | 0.5 | 530 |
| S4 | 1270 | 1237 | 0 | 34 | 10 | 620 | 50 | 0.8 | 522 |
| S5 | 1230 | 1176 | 0 | 37 | 10 | 630 | 50 | 2.3 | 489 |
| S6 | 1265 | 1236 | 0 | 32 | 10 | 620 | 50 | 3.3 | 408 |
| S7 | 1210 | 1185 | 0 | 35 | 10 | 620 | 50 | 3.8 | 405 |
| S8 | 1240 | 1226 | 0 | 36 | 10 | 610 | 50 | 4.3 | 400 |

TABLE 4-continued

| Steel | Heating temp at rolling (° C.) | T* (° C.) | Total reduction <1020° C.~>920° C. (%) | Total reduction 920° C.~ 860° C. (%) | Cooling rate (° C./sec) | Accelerated cooling end temp (° C.) | Plate thickness (mm) | Island martensite vol ratio (%) | Yield stress ½ t (MPa) |
|---|---|---|---|---|---|---|---|---|---|
| S9 | 1220 | 1195 | 0 | 34 | 10 | 620 | 50 | 5.3 | 385 |
| S10 | 1210 | 1177 | 0 | 37 | 10 | 630 | 50 | 6.2 | 370 |

*T = 6300/(1.9 − LogA) − 273; A = (Nb + 2 Ti) × (C + N × 12/14)

It can be seen from FIG. 1 that when island martensite is present at a ratio by volume of 3% or more, yield stress declines sharply. The reason for this is that the shape of the stress-strain curve in the tensile test changes greatly in the yield stress region. Specifically, as illustrated diagrammatically by the steel designated A in FIG. 2, the stress-strain curve of a steel in which island martensite is not present has an upper yield point. On the other hand, as illustrated diagrammatically by the steel designated B in FIG. 2, the stress-strain curve of a steel in which island martensite is present at a ratio of a few percent by volume is rounded with no appearance of a distinct upper yield point. This is because yield occurs locally (local yield) during low-stress load before an upper yield point appears, so that the yield stress when measured at 0.2% proof stress is lower than the yield stress of a steel in which an upper yield point arises. The yield stress measured at 0.2% proof stress of a steel in which island martensite is present is therefore markedly lower than that of a steel in which island martensite is not present. It is not clear why local yield occurs during tensile stress loading of a steel including island martensite but is believed to be because the formation of island martensite is accompanied by introduction of mobile dislocations caused by martensite transformation expansion in ferrite grains and/or in bainite grains adjacent to the island martensite, so that local yield is brought about by local movement of the mobile dislocations at the time of low-stress loading during tensile testing.

The inventors carried out a detailed study regarding island martensite formation conditions. As a result, they learned that in the case of the composition of the '819 invention, island martensite readily forms at the plate thickness center region of thick steel having a plate thickness of around 30 to 100 mm. One reason for this is that the composition of the '819 invention is characterized by the requirement of adding a large amount of Nb used to maximize precipitation hardening. Nb has an effect of delaying transformation from austenite to ferrite and bainite. And in the production process of the invention of '819, rolling is conducted at 860° C. or higher, and total rolling reduction at 920° C. or lower is limited to 50% or less. Rolling strain accumulation at the center region in a thick steel having a plate thickness of around 30 to 100 mm is therefore slight, so that grain refining of austenite grains through rolling strain-induced recrystallization does not readily occur, resulting in relatively coarse grains. When the austenite grains are coarse, the starting temperature of austenite transformation and/or bainite transformation is low. This results in the plate being passed to the slow cooling stage while bainite transformation at the plate thickness center region during post-rolling accelerated cooling is still deficient. It is supposed that this, in combination with the transformation-delaying effect of heavy Nb addition that characterizes the composition, leads to formation of island martensite, also during slow cooling, at some portions where bainite transformation and/or pearlite transformation is incomplete.

However, as shown in FIG. 1, in the case where the volume ratio of island martensite at the plate thickness center region is less than 3%, the reduction of yield stress is small, so less than 3% is the permissible range. When the yield stress at the thickness center region of a thick steel is required to be 500 MPa or greater, the island martensite volume ratio is preferably 1% or less.

The inventors next carried out a study regarding processes for reducing island martensite at the thickness center region. As shown in FIG. 3, they learned that generation of island martensite at the thickness center region can be held to 3% or less by reducing Si content to 0.10% or less. The effect of Si content on yield stress at the thickness center region is shown in FIG. 4. Yield stress at the thickness center region is markedly improved by reducing Si content to less than 0.10%. When the yield stress at the thickness center region of a thick steel is required to be 500 MPa or greater, the preferred Si content is 0.07% or less. It is not clear why island martensite formation can be inhibited by reducing Si content to 0.10% or less. However, it is known that Si delays growth of cementite owing to its resistance to dissolution in martensite. From this it is supposed that reduction of Si content promotes growth of cementite and that the resulting promotion of bainite transformation and/or pearlite transformation may inhibit island martensite formation.

The present invention became possible only after the foregoing knowledge was acquired. The gist of the present invention is as follows:

(1) A high-tensile steel plate of low acoustic anisotropy and high weldability having yield stress of 450 MPa or greater and tensile strength of 570 MPa or greater comprising, in mass %: C: 0.03% to 0.07%, Si: less than 0.10% (including 0%), Mn: 0.8% to 2.0%, and Al: 0.003% to 0.1%, comprising Nb and Ti at contents of, in mass %, Nb: 0.025% or more and Ti: 0.005% or more that satisfy $0.045\% \leqq [Nb]+2\times[Ti] \leqq 0.105\%$, comprising N: more than 0.0025 mass % and not more than 0.008 mass %, and comprising Nb, Ti, C and N at contents in ranges such that the value of A shown below is 0.0022 to 0.0055, weld cracking parameter for steel composition Pcm shown below being 0.18 or less, and a balance of Fe and unavoidable impurities, and having a steel structure wherein bainite volume ratio is 30% or more, pearlite volume ratio is less than 5%, and island martensite volume ratio is less than 3%:

$$A=([Nb]+2\times[Ti])\times([C]+[N]\times 12/14),$$

$$Pcm=[C]+[Si]/30+[Mn]/20+[Cu]/20+[Ni]/60+[Cr]/20+[Mo]/15+[V]/10+5[B],$$

where [Nb], [Ti], [C], [N], [Si], [Mn], [Cu], [Ni], [Cr], [Mo], [V] and [B] represent the contents of Nb, Ti, C, N, Si, Mn, Cu, Ni, Cr, Mo, V and B expressed in mass %.

(2) A high-tensile steel plate of low acoustic anisotropy and high weldability having yield stress of 450 MPa or greater and tensile strength of 570 MPa or greater according to (1), further comprising, in mass %, Mo: 0.05% to 0.3%.

(3) A high-tensile steel plate of low acoustic anisotropy and high weldability having yield stress of 450 MPa or greater and tensile strength of 570 MPa or greater according to (1) or (2), further comprising, in mass %, one or more of Cu: 0.1% to 0.8%, Ni: 0.1% to 1.0%, Cr: 0.1% to 0.8%, V: 0.01% or more to less than 0.03%, W: 0.1% to 3%, and B: 0.0005% to 0.0050%.

(4) A high-tensile steel plate of low acoustic anisotropy and high weldability having yield stress of 450 MPa or greater and tensile strength of 570 MPa or greater according to any of (1) to (3), further comprising, in mass %, one or both of Mg: 0.0005% to 0.01% and Ca: 0.0005% to 0.01%.

(5) A process for producing a high-tensile steel plate of low acoustic anisotropy and high weldability having yield stress of 450 MPa or greater and tensile strength of 570 MPa or greater, comprising: heating a billet or slab having a composition set out in any of (1) to (4) at a temperature between T (° C.) shown below and 1300° C., conducting rough rolling at a temperature in the range of 1020° C. and higher, holding total rolling reduction in the temperature range of lower than 1020° C. to higher than 920° C. to 15% or less, conducting finish rolling by which total reduction in the range of 920° C. to 860° C. is 20% to 50%, thereafter conducting accelerated cooling at a cooling rate of 2° C./sec to 30° C./sec starting from 800° C. or higher, terminating the accelerated cooling at a temperature between 700° C. and 600° C., and then conducting cooling at a cooling rate of 0.4° C./sec or less:

$$T=6300/(1.9-\text{Log}\,A)-273,$$

where A=([Nb]+2×[Ti])×([C]+[N]×12/14), [Nb], [Ti], [C] and [N] represent the contents of Nb, Ti, C and N expressed in mass %, and Log A is a common logarithm.

The present invention provides an up to 100 mm-thick high-tensile steel plate of low acoustic anisotropy and high weldability having yield stress of 450 MPa or greater and tensile strength of 570 MPa or greater, inclusive of at the plate thickness center region of a thick steel having a plate thickness of 30 to 100 mm, which high-tensile steel plate can be obtained by an as-rolled production process that adopts an economical composition low in added alloying elements and is high in productivity. As such, the effect of the invention on industry is very considerable.

DETAILED DESCRIPTION OF THE INVENTION

Figure 1:
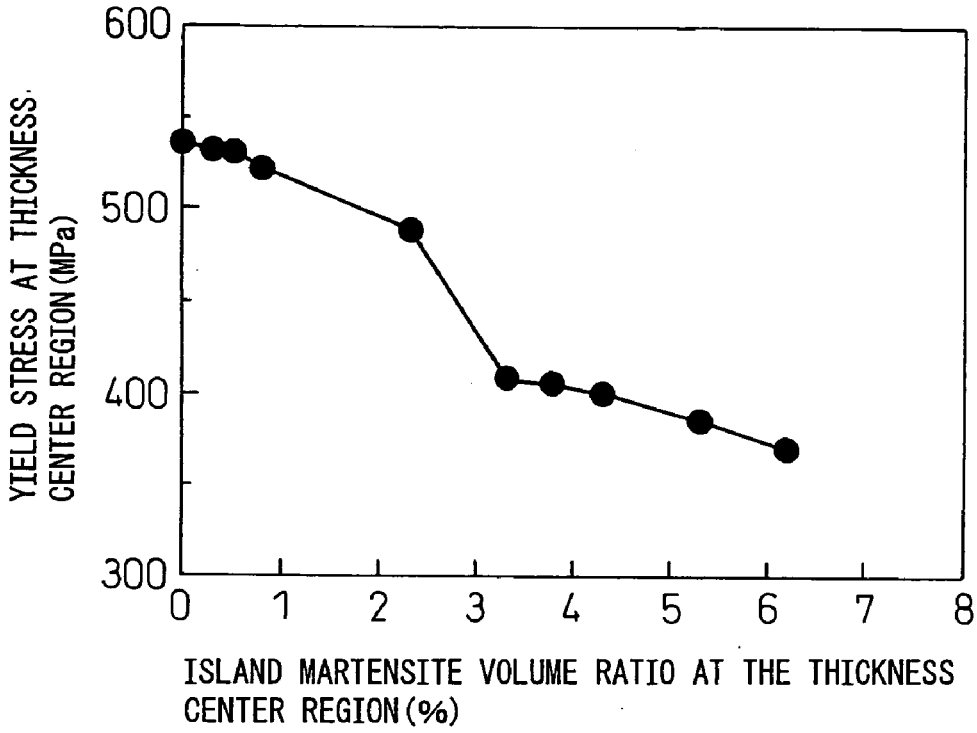
FIG. 1 is a graph showing how yield stress of a steel plate varies as a function of island martensite volume ratio at the thickness center region FIG. 2 diagrammatically contrasts the difference between the stress-strain curve during tensile testing of a steel plate (steel designated A) in which island martensite is not present and the stress-strain curve during tensile testing of a steel plate (steel designated B) in which island martensite is present.
Figure 2:
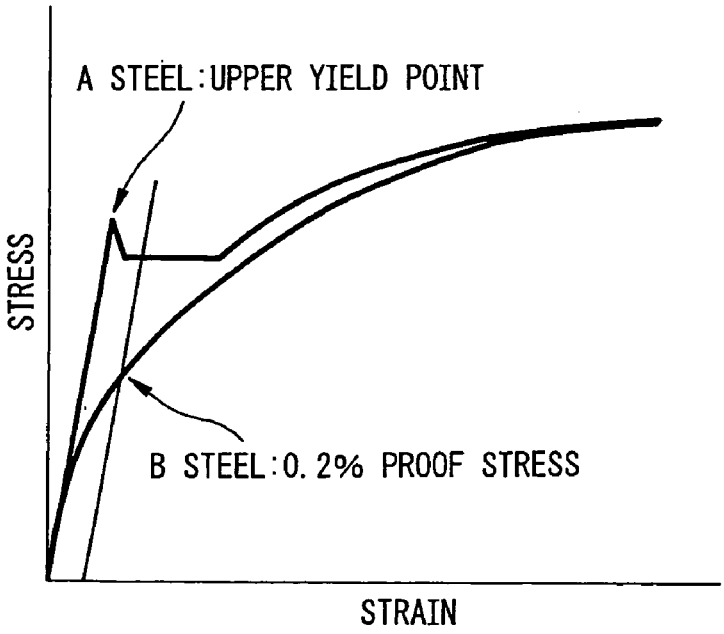
Figure 3:
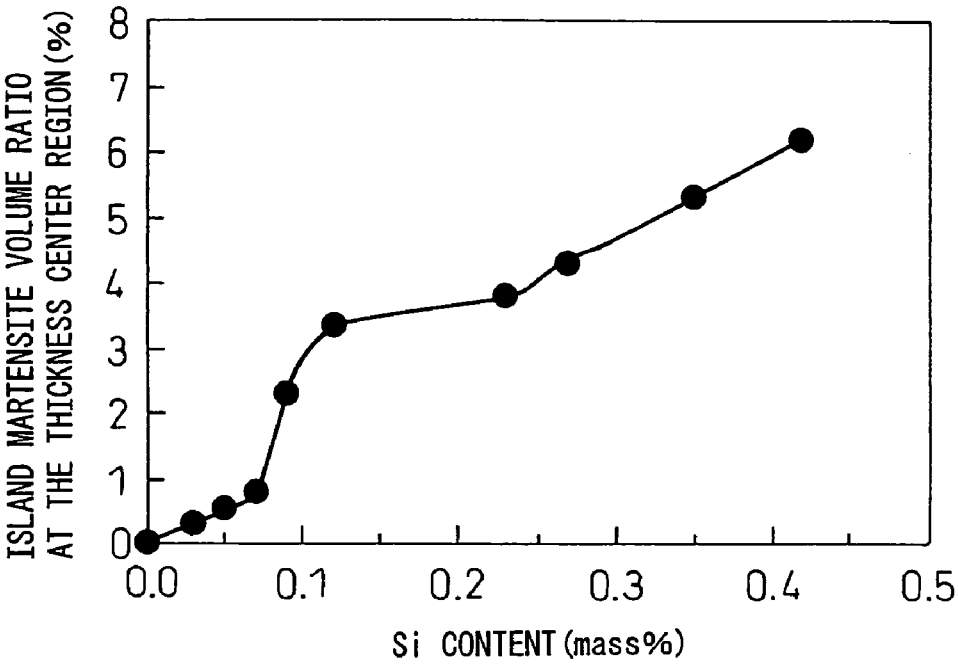
FIG. 3 is a graph showing how the Si content of a steel plate affects island martensite volume ratio at its thickness center region.
Figure 4:
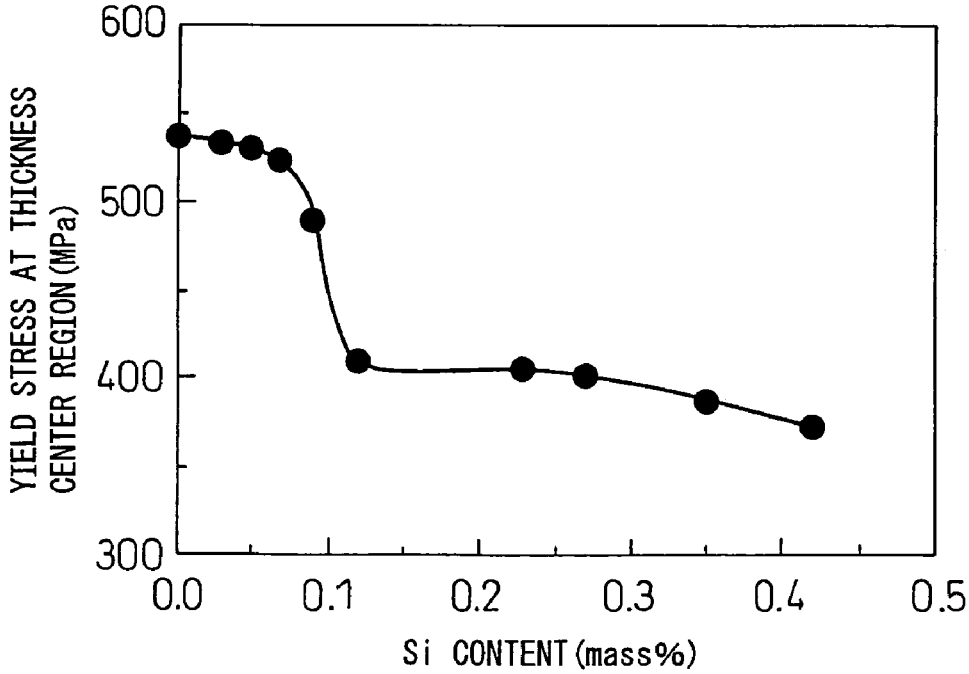
FIG. 4 is a graph showing how the Si content of a steel plate affects at yield stress its thickness center region.

The reasons for the limitations the present invention places on composition and microstructures, and the other essential elements of the invention, will be explained in the following.

C, which forms carbides and carbonitrides with Nb and Ti, is an important element that plays a primary role in the hardening mechanism of the invention steel. When C content is insufficient, desired strength cannot be obtained owing to deficient amount of precipitation during slow cooling following accelerated cooling termination. Excessive C content also prevents desired strength from being realized because the precipitation rate during rolling in the austenitic region increases, so that the coherent precipitation amount during slow cooling following accelerated cooling termination is insufficient. C content is therefore limited to the range of 0.03% to 0.07%.

Si needs to be limited to a content of less than 0.10% in order to inhibit island martensite formation. When Si content is 0.1% or more in a thick steel of a plate thickness of around 30 mm or larger, the island martensite volume ratio, particularly that at the thickness center region, comes to exceed 3%, so that yield stress (0.2% proof stress) and toughness tend to decrease. When the yield stress at the thickness center region of a thick steel is required to be 500 MPa or greater, the preferred Si content is 0.07% or less. A lower limit of Si content does not need to be defined, i.e.; the lower limit is 0%.

Mn is an element required for obtaining a hardenability-enhancing bainite single phase or mixed bainitic and ferritic structure of a bainite volume ratio of 30% or more. An Mn content of 0.8% or more is required for this purpose. The upper limit of Mn content is defined as 2.0% because addition in excess of 2.0% may degrade matrix toughness.

Al is added to a content of 0.003% to 0.1%, which is the ordinary range of addition as a deoxidizing element.

Nb and Ti form NbC, Nb(CN), TiC, TiN and Ti(CN), as well as complex precipitates thereof and complex precipitates thereof with Mo. As such, they are important elements that play a primary role in the hardening mechanism of the invention steel. In order to obtain sufficient complex precipitates in the interrupted accelerated cooling process, it is necessary to simultaneously add Nb to a content of 0.025% or more and Ti to a content of 0.005% or more and to control the addition so that [Nb]+2×[Ti] is 0.045% or more and that the value of A defined as ([Nb]+2×[Ti])×([C]+[N]×12/14) is 0.0022 or more (where [Nb], [Ti], [C] and [N] represent the contents of Nb, Ti, C and N expressed in mass %). When tensile strength exceeding 570 MPa, e.g., tensile strength of 600 MPa or greater, is required, it is preferable to simultaneously add Nb to a content of 0.035% or more and Ti to a content of 0.005% or more and to control the addition so that [Nb]+2×[Ti] is 0.055% or more. When [Nb]+2×[Ti] exceeds 0.105%, the formed precipitates tend to be coarse owing to the excessive addition of Nb and Ti, so that the number of precipitates decreases despite the larger amount of added Nb and Ti, thereby lowering the degree of precipitation hardening and making it impossible to achieve tensile strength of 570 MPa. [Nb]+2×[Ti] must therefore be made 0.105% or less. When the value of A, i.e., ([Nb]+2×[Ti])×([C]+[N]×12/14), exceeds 0.0055, the precipitation rate of carbides, nitrides and carbonitrides in the austenite becomes too high, so that the precipitates coarsen to make the amount of coherent precipitation during slow cooling following accelerated cooling termination insufficient. The resulting decline in precipitation hardening amount makes it impossible to achieve tensile strength of 570 MPa. The value of A must therefore be made 0.0055 or less.

N bonds with Ti to form TiN. Finely dispersed TiN has a pinning effect that inhibits coarsening of weld heat-affected zone microstructures, thereby improving weld heat-affected zone toughness. However, when N is deficient to the level of 0.0025% or less, TiN coarsens and the pinning effect cannot be obtained. An N content in excess of at least 0.0025% is therefore required to achieve fine dispersion of TiN. In order to utilize the effect of fine TiN dispersion to improve toughness even at regions near the fusion line (FL), which are exposed to high temperatures of the weld heat-affected zone (HAZ), the N content is preferably made more than 0.004%. As excessive N content may instead degrade the toughness of the matrix and welded joints, the upper limit of allowable content is defined as 0.008%. When decrease in toughness must be inhibited to the utmost possible, the upper limit of N is preferably defined as 0.006%.

Mo improves hardenability and further forms complex precipitates with Nb and Ti, thereby making a major contribution to strengthening. To obtain this effect, Mo is added to a content of 0.05% or more. However, since excessive addition impairs weld heat-affected zone toughness, Mo addition is limited to 0.3% or less.

Cu, when used as a strengthening element, needs to be added to a content of 0.1% or more to produce the strengthening effect. When the amount added exceeds 0.8%, the effect of further addition is small in proportion to the amount added and excessive addition may impair weld heat-affected zone toughness; so the upper limit of addition is defined as 0.8%.

Ni, when used to increase matrix strength, must be added to a content of 0.1% or more. Excessive addition may impair weldability. In view of this and the fact that Ni is an expensive element, the upper limit of addition is defined as 1.0%.

Cr, like Mn, increases hardenability and makes bainite structure easier to obtain. For achieving these purposes, Cr is added to a content of 0.1% or more. As excessive addition impairs weld heat-affected zone toughness, the upper limit of addition is defined as 0.8%.

V, while weaker in strengthening effect than Nb and Ti, has some amount effect toward improving precipitation hardening and hardenability. Addition to a content of 0.01% or more is required to realize this effect. Since excessive addition impairs weld heat-affected zone toughness, the upper limit of addition is defined as less than 0.03%.

W improves strength. When used, it is added to a content of 0.1% or more. The upper limit of addition is defined as 3% or less because addition of a large amount increases cost.

B, when used to increase hardenability and establish strength, must be added to a content of 0.0005% or more. As the effect remains unchanged at addition in excess of 0.0050%, the amount of B addition is defined as 0.0005% to 0.0050%.

Mg and Ca can be added individually or in combination to increase matrix toughness and weld heat-affected zone toughness by formation of sulfides and/or oxides. For realizing these effects, Mg and Ca must each be added to a content of 0.0005% or more. However, excessive addition to over 0.01% causes formation of coarse sulfides and or oxides that degrade toughness. The amount of each of Mg and Ca added is therefore defined as 0.0005% to 0.01%.

P and S are present in addition to the forgoing constituents as unavoidable impurities. The lower the content of these elements the better, because both are harmful elements that degrade matrix toughness. Preferably, P content should be 0.02% or less and S content 0.02% or less.

Further, when weld cracking parameter for steel composition Pcm exceeds 0.18, it becomes impossible to avoid a decline in weld heat-affected zone toughness at the time of high heat input welding. Pcm must therefore be made 0.18 or less. As termed here, Pcm=[C]+[Si]/30+[Mn]/20+[Cu]/20+[Ni]/60+[Cr]/20+[Mo]/15+[V]/10+5[B], where [C], [Si], [Mn], [Cu], [Ni], [Cr], [Mo], [V] and [B] represent the contents of C, Si, Mn, Cu, Ni, Cr, Mo, V and B expressed in mass %.

In the present invention, it is desirable to achieve good strength by promoting fine coherent precipitation of Nb and Ti carbides, nitrides and carbonitrides. For this, abundant dislocations, deformation bands and other such precipitation sites are preferably present in the worked structures. From this viewpoint, bainitic structure is the preferred metal structure because it more readily retains dislocation density and other worked structures than ferritic structure. Tensile strength of 570 MPa is hard to achieve when the volume ratio of bainite is less than 30%. So the bainite volume ratio is required to be 30% or more.

When pearlite is present, Nb and Ti carbides, nitrides and carbonitrides precipitate at the pearlite phase boundary to lower the strengthening effect being sought. This makes it difficult to achieve tensile strength of 570 MPa and also lowers toughness and the like. Although pearlite must therefore be reduced to the utmost, its adverse effects are small at a volume ratio of less than 5%, so this is the allowable range.

Presence of island martensite lowers yield stress (upper yield point or 0.2% proof stress) and/or toughness. Although island martensite must therefore be reduced to the utmost, its adverse effects are small at a volume ratio of less than 3%, so this is the allowable range. Island martensite readily forms particularly at the plate thickness center region. In order to achieve yield stress of 450 MPa at the thickness center region, the volume ratio of island martensite must be made less than 3% also at the thickness center region. The preferred island martensite volume ratio is less than 2%.

The essential elements of the present invention aside from those relating to the composition, i.e., those relating to the production process, will be explained next.

In order to dissolve Nb and Ti thoroughly as solid solution, the heating temperature of the billet or slab is made higher than temperature T (° C.) calculated by the following conditional expression including A value:

$$T=6300/(1.9-\mathrm{Log}\,A)-273,$$

where A=([Nb]+2×[Ti])×([C]+[N]×12/14), [Nb], [Ti], [C] and [N] represent the contents of Nb, Ti, C and N expressed in mass %, and Log A is a common logarithm. At a heating temperature exceeding 1300° C., however, the austenite grain diameter enlarges to lower toughness. The heating temperature of the billet or slab during rolling is therefore defined as between T (° C.) and 1300° C.

In order to inhibit Nb and Ti precipitation during rolling to the utmost possible, roughing is conducted at an appropriate reduction in the temperature range of 1020° C. and higher, and total reduction in rolling conducted in the range of less than 1020° C. to higher than 920° C. is made 15% or less. Moreover, in order to obtain necessary and sufficient worked structures as precipitation sites, rolling is conducted in the range between 920° C. and 860° C. at a total reduction of 20 to 50%. Under these rolling conditions, acoustic anisotropy does not become large because formation of texture is inhibited.

Worked structure recovery and post-working precipitation is inhibited by conducting accelerated cooling immediately after the rolling. The accelerated cooling is conducted under conditions of a cooling rate of 2° C./sec to 30° C./sec starting from 800° C. or higher. To obtain a volume ratio of bainite of 30% or more, the cooling rate must be 2° C./sec or more, while to keep the volume ratio of pearlite to less than 5% and the volume ratio of island martensite to less than 3%, the upper limit of the cooling rate must be 30° C./sec or less. The accelerated cooling is interrupted to obtain a steel plate temperature between 700° C. and 600° C., whereafter cooling is conducted at a cooling rate of 0.4° C./sec or less by open cooling or the like. The purpose of this is to secure temperature and time sufficient for ensuring precipitation of Ni and Ti, as well as complex precipitation thereof and complex precipitation thereof with Mo. Bainitic structure is hard to obtain when the accelerated cooling termination temperature is too high, while precipitation slows to make sufficient strengthening impossible when it is too low. Since the steel plate center temperature is higher than the surface temperature immediately after accelerated cooling termination, the temperature of the steel plate surface once increases owing to heat recuperation but thereafter cools. "Accelerated cooling termination temperature" as termed here means the highest steel plate surface temperature reached after recuperation.

The invention steel is used in the form of thick steel plate in the structural members of welded structures such as bridges, ships, buildings, marine structures, pressure vessels, penstocks, line pipes and the like.

EXAMPLES

Steels of the compositions shown in Tables 5 and 6 were produced and the obtained slabs were processed into 12 to 100-mm thick steel plates under the production conditions shown in Tables 7 and 8. Among these, 1-A to 20-T are invention steels and 21-U to 48-A are comparative steels. In the tables, an underlined numeral indicates that the value for the component or production condition is outside the invention range or that the value for a property does not satisfy the desired value shown below the table.

TABLE 5

| | | Chemical composition (Mass %) | | | | | | | | | | | |
|---|---|---|---|---|---|---|---|---|---|---|---|---|---|
| | Steel | C | Si | Mn | P | S | Cu | Ni | Cr | Mo | Al | Nb | Ti |
| Invention steels | A | 0.07 | 0.00 | 2.00 | 0.016 | 0.009 | | | | | 0.005 | 0.038 | 0.014 |
| | B | 0.07 | 0.02 | 1.98 | 0.014 | 0.004 | | | | 0.11 | 0.041 | 0.039 | 0.017 |
| | C | 0.04 | 0.09 | 1.02 | 0.015 | 0.007 | | | | 0.12 | 0.056 | 0.049 | 0.017 |
| | D | 0.06 | 0.04 | 1.09 | 0.008 | 0.017 | | | | 0.06 | 0.016 | 0.049 | 0.019 |
| | E | 0.04 | 0.06 | 1.33 | 0.005 | 0.011 | | | | 0.13 | 0.040 | 0.039 | 0.019 |
| | F | 0.04 | 0.05 | 1.41 | 0.006 | 0.015 | | | | | 0.064 | 0.025 | 0.019 |
| | G | 0.06 | 0.05 | 0.87 | 0.016 | 0.013 | | | | 0.23 | 0.049 | 0.044 | 0.019 |
| | H | 0.04 | 0.03 | 1.51 | 0.012 | 0.013 | | | | 0.14 | 0.038 | 0.045 | 0.009 |
| | I | 0.05 | 0.03 | 1.27 | 0.009 | .0.002 | | | | 0.18 | 0.022 | 0.043 | 0.020 |
| | J | 0.06 | 0.03 | 1.81 | 0.016 | 0.010 | | | | | 0.075 | 0.050 | 0.014 |
| | K | 0.06 | 0.06 | 1.21 | 0.007 | 0.011 | | | | 0.26 | 0.069 | 0.040 | 0.015 |
| | L | 0.06 | 0.02 | 1.60 | 0.013 | 0.018 | | 0.68 | | 0.28 | 0.028 | 0.041 | 0.020 |
| | M | 0.04 | 0.02 | 1.41 | 0.016 | 0.011 | | | 0.17 | 0.21 | 0.050 | 0.036 | 0.017 |
| | N | 0.05 | 0.09 | 1.56 | 0.008 | 0.009 | 0.51 | | | 0.06 | 0.031 | 0.049 | 0.007 |
| | O | 0.05 | 0.02 | 1.01 | 0.012 | 0.006 | | | | 0.26 | 0.010 | 0.037 | 0.008 |
| | P | 0.06 | 0.02 | 0.86 | 0.010 | 0.013 | 0.70 | 0.38 | | 0.10 | 0.017 | 0.041 | 0.011 |
| | Q | 0.05 | 0.04 | 1.97 | 0.006 | 0.007 | | | | 0.19 | 0.020 | 0.027 | 0.014 |
| | R | 0.06 | 0.09 | 1.05 | 0.007 | 0.004 | | | | 0.13 | 0.071 | 0.042 | 0.013 |
| | S | 0.03 | 0.07 | 1.25 | 0.005 | 0.005 | 0.29 | 0.88 | 0.50 | | 0.020 | 0.065 | 0.007 |
| | T | 0.03 | 0.02 | 1.40 | 0.012 | 0.002 | 0.58 | 0.62 | 0.40 | 0.22 | 0.064 | 0.095 | 0.005 |

| | | Chemical composition (Mass %) | | | | | | | | |
|---|---|---|---|---|---|---|---|---|---|---|
| | Steel | Nb + 2Ti | A** | V | W | B | Mg | Ca | N | Pcm* |
| Invention steels | A | 0.066 | 0.0049 | | | | | | 0.0045 | 0.170 |
| | B | 0.073 | 0.0054 | | | | | | 0.0042 | 0.177 |
| | C | 0.083 | 0.0037 | | | | | | 0.0050 | 0.102 |
| | D | 0.087 | 0.0055 | | | | | | 0.0032 | 0.120 |
| | E | 0.077 | 0.0034 | | | | | | 0.0052 | 0.117 |
| | F | 0.063 | 0.0027 | | | 0.0016 | | | 0.0027 | 0.120 |
| | G | 0.082 | 0.0052 | | | | | | 0.0044 | 0.121 |
| | H | 0.063 | 0.0027 | | | | | | 0.0028 | 0.126 |
| | I | 0.083 | 0.0046 | 0.024 | | | | | 0.0057 | 0.129 |
| | J | 0.078 | 0.0050 | | 0.11 | | | | 0.0055 | 0.152 |
| | K | 0.070 | 0.0045 | | | 0.0017 | | | 0.0050 | 0.148 |
| | L | 0.081 | 0.0050 | | | | | | 0.0027 | 0.170 |
| | M | 0.070 | 0.0031 | | | | | | 0.0042 | 0.134 |
| | N | 0.063 | 0.0035 | | | | | | 0.0056 | 0.161 |
| | O | 0.053 | 0.0028 | 0.026 | | | 0.0045 | | 0.0028 | 0.121 |
| | P | 0.063 | 0.0040 | | | 0.0014 | | | 0.0035 | 0.159 |
| | Q | 0.055 | 0.0029 | | | | 0.0020 | | 0.0029 | 0.163 |
| | R | 0.068 | 0.0044 | | | | | 0.0049 | 0.0060 | 0.124 |
| | S | 0.079 | 0.0026 | | | | | | 0.0029 | 0.149 |
| | T | 0.105 | 0.0034 | | | 0.0010 | | | 0.0026 | 0.180 |

*Pcm = C + Si/30 + Mn/20 + Cu/20 + Ni/60 + Cr/20 + Mo/15 + V/10 + 5B

**A = (Nb + 2 Ti) × (C + N × 12/14)

TABLE 6

| | Steel | Chemical composition (Mass %) | | | | | | | | | | | |
|---|---|---|---|---|---|---|---|---|---|---|---|---|---|
| | | C | Si | Mn | P | S | Cu | Ni | Cr | Mo | Al | Nb | Ti |
| Comparative steels | U | 0.02 | 0.08 | 1.95 | 0.006 | 0.006 | | | | 0.17 | 0.065 | 0.063 | 0.006 |
| | V | 0.09 | 0.08 | 0.89 | 0.011 | 0.017 | | | | 0.25 | 0.045 | 0.030 | 0.022 |
| | W | 0.06 | 0.18 | 1.74 | 0.013 | 0.016 | | | | 0.13 | 0.057 | 0.032 | 0.020 |
| | X | 0.06 | 0.38 | 1.16 | 0.005 | 0.014 | | | | 0.06 | 0.019 | 0.063 | 0.007 |
| | Y | 0.07 | 0.07 | 0.76 | 0.018 | 0.019 | | | | 0.27 | 0.063 | 0.043 | 0.012 |
| | Z | 0.04 | 0.07 | 2.43 | 0.004 | 0.017 | | | | 0.10 | 0.066 | 0.055 | 0.015 |
| | AA | 0.06 | 0.07 | 0.93 | 0.006 | 0.003 | | | | 0.62 | 0.060 | 0.026 | 0.016 |
| | AB | 0.04 | 0.08 | 1.89 | 0.004 | 0.005 | | | | 0.15 | 0.004 | 0.012 | 0.022 |
| | AC | 0.03 | 0.09 | 1.90 | 0.019 | 0.015 | | | | | 0.004 | 0.108 | 0.019 |
| | AD | 0.06 | 0.05 | .166 | 0.018 | 0.017 | | | | 0.15 | 0.029 | 0.051 | 0.003 |
| | AE | 0.04 | 0.05 | 1.37 | 0.014 | 0.008 | | | | 0.26 | 0.013 | 0.062 | 0.045 |
| | AF | 0.03 | 0.08 | 1.93 | 0.012 | 0.010 | | | | 0.20 | 0.047 | 0.035 | 0.012 |
| | AG | 0.07 | 0.09 | 1.24 | 0.004 | 0.020 | | | | 0.10 | 0.044 | 0.047 | 0.025 |
| | AH | 0.04 | 0.08 | 1.61 | 0.015 | 0.012 | | | | 0.12 | 0.053 | 0.056 | 0.011 |
| | AI | 0.06 | 0.09 | 0.85 | 0.007 | 0.008 | | | | 0.17 | 0.041 | 0.056 | 0.018 |
| | AJ | 0.06 | 0.05 | 1.24 | 0.009 | 0.003 | | | | 0.22 | 0.034 | 0.057 | 0.022 |
| | AK | 0.05 | 0.06 | 0.88 | 0.011 | 0.002 | 1.28 | | | 0.15 | 0.066 | 0.026 | 0.011 |
| | AL | 0.05 | 0.06 | 1.49 | 0.020 | 0.011 | | 1.78 | | 0.19 | 0.050 | 0.066 | 0.019 |
| | AM | 0.05 | 0.08 | 1.15 | 0.019 | 0.017 | | | 1.15 | 0.15 | 0.035 | 0.044 | 0.019 |
| | AN | 0.06 | 0.08 | 1.77 | 0.019 | 0.008 | | | | 0.20 | 0.022 | 0.034 | 0.007 |
| | AO | 0.06 | 0.08 | 1.58 | 0.016 | 0.008 | | | | 0.13 | 0.002 | 0.044 | 0.018 |

| | Steel | Chemical composition (Mass %) | | | | | | | | |
|---|---|---|---|---|---|---|---|---|---|---|
| | | Nb + 2Ti | A** | V | W | B | Mg | Ca | N | Pcm* |
| Comparative steels | U | 0.075 | 0.0019 | | | | | | 0.0055 | 0.132 |
| | V | 0.074 | 0.0070 | | | | | | 0.0052 | 0.154 |
| | W | 0.072 | 0.0046 | | | | | | 0.0044 | 0.162 |
| | X | 0.077 | 0.0050 | | | | | | 0.0050 | 0.135 |
| | Y | 0.067 | 0.0049 | | | | | | 0.0029 | 0.128 |
| | Z | 0.085 | 0.0037 | | | | | | 0.0043 | 0.171 |
| | AA | 0.058 | 0.0037 | | | | | | 0.0053 | 0.150 |
| | AB | 0.056 | 0.0024 | | | | | | 0.0039 | 0.147 |
| | AC | 0.146 | 0.0048 | | | | | | 0.0032 | 0.128 |
| | AD | 0.057 | 0.0036 | | | | | | 0.0028 | 0.155 |
| | AE | 0.152 | 0.0068 | | | | | | 0.0054 | 0.128 |
| | AF | 0.059 | 0.0019 | | | | | | 0.0026 | 0.143 |
| | AG | 0.097 | 0.0071 | | | | | | 0.0041 | 0.142 |
| | AH | 0.078 | 0.0033 | | | | | | 0.0022 | 0.131 |
| | AI | 0.092 | 0.065 | | | | | | 0.0119 | 0.117 |
| | AJ | 0.101 | 0.0064 | 0.070 | | | | | 0.0036 | 0.144 |
| | AK | 0.048 | 0.0026 | | | | | | 0.0059 | 0.170 |
| | AL | 0.104 | 0.0055 | | | | | | 0.0039 | 0.169 |
| | AM | 0.082 | 0.0045 | | | | | | 0.0057 | 0.178 |
| | AN | 0.048 | 0.0031 | | | | 0.017 | | 0.0043 | 0.165 |
| | AO | 0.080 | 0.0051 | | | | | 0.015 | 0.0047 | 0.150 |

*Pcm = C + Si/30 + Mn/20 + Cu/20 + Ni/60 + Cr/20 + Mo/15 + V/10 + 5B

**A = (Nb + 2 Ti) × (C + N × 12/14)

TABLE 7

| | Production Conditions No. | Steel | Heating temp at rolling (° C.) | T* (° C.) | Total reduction <1020° C.~>920° C. (%) | Total reduction 920° C.~860° C. (%) | Cooling rate (° C./sec) | Accelerated cooling end temp (° C.) | Plate thickness (mm) | Bainite vol ratio (%) |
|---|---|---|---|---|---|---|---|---|---|---|
| Invention steels | 1 | A | 1280 | 1223 | 0 | 31 | 10 | 610 | 50 | 90 |
| | 2 | B | 1260 | 1238 | 0 | 30 | 6 | 600 | 75 | 85 |
| | 3 | C | 1260 | 1180 | 15 | 50 | 30 | 700 | 12 | 30 |
| | 4 | D | 1270 | 1240 | 10 | 45 | 20 | 650 | 25 | 78 |
| | 5 | E | 1190 | 1170 | 0 | 42 | 15 | 630 | 35 | 87 |
| | 6 | F | 1250 | 1135 | 0 | 39 | 15 | 630 | 35 | 90 |
| | 7 | G | 1260 | 1234 | 0 | 32 | 15 | 630 | 35 | 93 |
| | 8 | H | 1280 | 1135 | 0 | 31 | 12 | 620 | 40 | 89 |
| | 9 | I | 1270 | 1212 | 0 | 36 | 12 | 620 | 40 | 88 |
| | 10 | J | 1270 | 1228 | 0 | 37 | 10 | 610 | 50 | 87 |
| | 11 | K | 1230 | 1210 | 0 | 34 | 10 | 620 | 50 | 86 |
| | 12 | L | 1240 | 1228 | 0 | 22 | 8 | 600 | 60 | 83 |

TABLE 7-continued

| | | | | | | | | | |
|---|---|---|---|---|---|---|---|---|---|
| 13 | M | 1170 | 1154 | 0 | 38 | 15 | 630 | 35 | 93 |
| 14 | N | 1220 | 1171 | 0 | 40 | 8 | 640 | 60 | 68 |
| 15 | O | 1260 | 1141 | 8 | 31 | 20 | 660 | 25 | 81 |
| 16 | P | 1220 | 1192 | 0 | 38 | 10 | 620 | 50 | 92 |
| 17 | Q | 1210 | 1146 | 0 | 31 | 10 | 620 | 50 | 93 |
| 18 | R | 1270 | 1208 | 0 | 30 | 15 | 630 | 35 | 95 |
| 19 | S | 1270 | 1130 | 0 | 42 | 10 | 610 | 50 | 94 |
| 20 | T | 1230 | 1168 | 0 | 39 | 3 | 600 | 100 | 76 |

| | Production Conditions No. | Pearlite vol ratio (%) | Island martensite vol ratio (%) | Yield stress (MPa) ¼ t | Yield stress (MPa) ½ t | Tensile strength (MPa) ¼ t | Tensile strength (MPa) ½ t | Matrix toughness vTrs (° C.) | Weld heat-affected zone toughness vE−20 (J) | Acoustic Anisotropy (sound velocity ratio) |
|---|---|---|---|---|---|---|---|---|---|---|
| Invention steels | 1 | <1 | 1 | 523 | 510 | 620 | 611 | −55 | 276 | 1.01 |
| | 2 | 3 | 2 | 513 | 505 | 596 | 588 | −50 | 248 | 1.01 |
| | 3 | 4 | 2 | 555 | | 635 | | −80 | 308 | 1.00 |
| | 4 | <1 | <1 | 564 | | 650 | | −65 | 254 | 1.00 |
| | 5 | <1 | <1 | 535 | 524 | 645 | 635 | −50 | 316 | 1.01 |
| | 6 | <1 | <1 | 546 | 534 | 634 | 626 | −70 | 281 | 1.01 |
| | 7 | <1 | <1 | 545 | 529 | 650 | 639 | −60 | 249 | 1.01 |
| | 8 | <1 | 1 | 543 | 528 | 646 | 634 | −55 | 324 | 1.01 |
| | 9 | <1 | 1 | 534 | 523 | 622 | 609 | −65 | 264 | 1.01 |
| | 10 | 1 | 1 | 532 | 522 | 631 | 629 | −60 | 316 | 1.01 |
| | 11 | 1 | 1 | 536 | 512 | 633 | 620 | −55 | 259 | 1.01 |
| | 12 | 1 | 2 | 517 | 505 | 606 | 597 | −45 | 292 | 1.00 |
| | 13 | <1 | <1 | 555 | 537 | 647 | 634 | −60 | 311 | 1.01 |
| | 14 | 4 | 2 | 488 | 467 | 612 | 589 | −55 | 256 | 1.00 |
| | 15 | <1 | <1 | 562 | | 641 | | −65 | 276 | 1.00 |
| | 16 | 1 | 2 | 529 | 507 | 634 | 612 | −50 | 316 | 1.01 |
| | 17 | 1 | 2 | 522 | 509 | 638 | 627 | −50 | 302 | 1.00 |
| | 18 | <1 | <1 | 567 | 547 | 667 | 654 | −65 | 290 | 1.02 |
| | 19 | 1 | 2 | 533 | 512 | 635 | 623 | −50 | 254 | 1.00 |
| | 20 | 3 | 2 | 468 | 459 | 590 | 588 | −40 | 303 | 1.00 |

*T = 6300/(1.9 − LogA) − 273; A = (Nb + 2 Ti) × (C + N × 12/14)

TABLE 8

| | Production Conditions No. | Steel | Heating temp at rolling (° C.) | T* (° C.) | Total reduction <1020° C.~>920° C. (%) | Total reduction 920° C.~860° C. (%) | Cooling rate (° C./sec) | Accelerated cooling end temp (° C.) | Plate thickness (mm) | Bainite vol ratio (%) |
|---|---|---|---|---|---|---|---|---|---|---|
| Comparative steels | 21 | U | 1250 | 1087 | 0 | 39 | 10 | 610 | 50 | 55 |
| | 22 | V | 1290 | 1280 | 0 | 39 | 10 | 600 | 50 | 85 |
| | 23 | W | 1230 | 1214 | 0 | 39 | 9 | 610 | 50 | 40 |
| | 24 | X | 1250 | 1225 | 0 | 39 | 10 | 620 | 50 | 78 |
| | 25 | Y | 1250 | 1222 | 0 | 45 | 10 | 630 | 50 | 87 |
| | 26 | Z | 1200 | 1182 | 0 | 39 | 10 | 600 | 50 | 90 |
| | 27 | AA | 1200 | 1183 | 0 | 39 | 10 | 610 | 50 | 93 |
| | 28 | AB | 1180 | 1122 | 0 | 39 | 10 | 650 | 50 | 62 |
| | 29 | AC | 1240 | 1220 | 0 | 39 | 10 | 620 | 50 | 46 |
| | 30 | AD | 1200 | 1176 | 0 | 50 | 8 | 610 | 50 | 87 |
| | 31 | AE | 1290 | 1275 | 0 | 39 | 10 | 620 | 50 | 80 |
| | 32 | AF | 1180 | 1090 | 0 | 40 | 10 | 600 | 50 | 83 |
| | 33 | AG | 1290 | 1284 | 0 | 40 | 10 | 630 | 50 | 93 |
| | 34 | AH | 1200 | 1163 | 0 | 35 | 10 | 610 | 50 | 80 |
| | 35 | AI | 1280 | 1267 | 0 | 39 | 10 | 620 | 50 | 81 |
| | 36 | AJ | 1280 | 1265 | 0 | 39 | 10 | 620 | 50 | 92 |
| | 37 | AK | 1200 | 1134 | 0 | 39 | 8 | 620 | 50 | 93 |
| | 38 | AL | 1260 | 1243 | 0 | 39 | 10 | 630 | 50 | 95 |
| | 39 | AM | 1240 | 1210 | 0 | 35 | 10 | 610 | 50 | 94 |
| | 40 | AN | 1200 | 1154 | 0 | 39 | 10 | 640 | 50 | 78 |
| | 41 | AO | 1240 | 1230 | 0 | 39 | 9 | 650 | 50 | 76 |
| | 42 | A | 1200 | 1223 | 0 | 35 | 10 | 600 | 50 | 76 |
| | 43 | A | 1240 | 1223 | 25 | 35 | 10 | 610 | 50 | 76 |
| | 44 | A | 1240 | 1223 | 0 | 10 | 10 | 600 | 50 | 76 |
| | 45 | A | 1240 | 1223 | 0 | 60 | 10 | 620 | 50 | 76 |
| | 46 | A | 1240 | 1223 | 0 | 48 | 1 | 680 | 35 | 40 |
| | 47 | A | 1240 | 1223 | 0 | 40 | 10 | 740 | 50 | 48 |
| | 48 | A | 1240 | 1223 | 0 | 40 | 10 | 480 | 50 | 98 |

TABLE 8-continued

| | Production Conditions No. | Pearlite vol ratio (%) | Island martensite vol ratio (%) | Yield stress (MPa) ¼ t | Yield stress (MPa) ½ t | Tensile strength (MPa) ¼ t | Tensile strength (MPa) ½ t | Matrix toughness vTrs (° C.) | Weld heat-affected zone toughness vE−20 (J) | Acoustic Anisotropy (sound velocity ratio) |
|---|---|---|---|---|---|---|---|---|---|---|
| Comparative steels | 21 | <1 | 1 | 432 | 422 | 521 | 508 | −75 | 276 | 1.01 |
| | 22 | 6 | 2 | 448 | 432 | 546 | 534 | −75 | 248 | 1.02 |
| | 23 | 4 | 3 | 495 | 410 | 635 | 621 | −55 | 308 | 1.00 |
| | 24 | <1 | 5 | 489 | 408 | 615 | 605 | −55 | 254 | 1.01 |
| | 25 | <1 | <1 | 467 | 462 | 536 | 522 | −55 | 316 | 1.01 |
| | 26 | <1 | 2 | 509 | 489 | 655 | 642 | −5 | 63 | 1.01 |
| | 27 | <1 | 2 | 502 | 478 | 650 | 639 | −25 | 27 | 1.01 |
| | 28 | 4 | 1 | 436 | 423 | 522 | 518 | −70 | 335 | 1.01 |
| | 29 | 2 | 2 | 468 | 453 | 596 | 586 | −30 | 32 | 1.02 |
| | 30 | 1 | <1 | 445 | 433 | 563 | 555 | −60 | 125 | 1.01 |
| | 31 | 1 | <1 | 515 | 498 | 605 | 597 | −35 | 19 | 1.01 |
| | 32 | 1 | <1 | 450 | 432 | 560 | 545 | −65 | 342 | 1.00 |
| | 33 | <1 | 1 | 459 | 445 | 565 | 559 | −40 | 22 | 1.01 |
| | 34 | 2 | 1 | 499 | 477 | 615 | 590 | −75 | 32 | 1.01 |
| | 35 | 2 | <1 | 506 | 489 | 610 | 592 | −1 | 18 | 1.00 |
| | 36 | 1 | <1 | 527 | 504 | 625 | 610 | −65 | 38 | 1.01 |
| | 37 | 1 | <1 | 479 | 468 | 599 | 576 | −30 | 36 | 1.00 |
| | 38 | <1 | <1 | 478 | 462 | 593 | 579 | −55 | 44 | 1.02 |
| | 39 | 1 | <1 | 496 | 477 | 630 | 618 | −65 | 29 | 1.01 |
| | 40 | 3 | 2 | 466 | 458 | 618 | 597 | −5 | 39 | 1.01 |
| | 41 | 3 | 2 | 460 | 448 | 596 | 587 | −10 | 44 | 1.00 |
| | 42 | 3 | <1 | 446 | 439 | 568 | 559 | −60 | 275 | 1.01 |
| | 43 | 3 | <1 | 445 | 428 | 567 | 545 | −55 | 220 | 1.00 |
| | 44 | 3 | <1 | 440 | 432 | 567 | 565 | −15 | 289 | 1.00 |
| | 45 | 3 | <1 | 435 | 425 | 557 | 546 | −55 | 270 | 1.04 |
| | 46 | 3 | 6 | 408 | 376 | 590 | 569 | −55 | 288 | 1.01 |
| | 47 | 3 | 2 | 435 | 422 | 541 | 537 | −75 | 303 | 1.00 |
| | 48 | <1 | <1 | 426 | 418 | 567 | 562 | −80 | 278 | 1.01 |

*T = 6300/(1.9 − LogA) − 273; A = (Nb + 2 Ti) × (C + N × 12/14)

The measured matrix strengths, toughnesses, weld heat-affected zone toughnesses, and acoustic anisotropies of the steel plates are shown in Tables 7 and 8. Matrix strength was measured in conformity with the method of JIS Z 2241 using a No. 1A full-thickness tensile test piece or No. 4 rod tensile test piece sampled in conformity with JIS Z 2201. When the plate thickness was 25 mm or less, a No. 1A full-thickness tensile test piece was sampled. When the plate thickness was larger than 25 mm, No. 4 rod tensile test pieces were sampled at the ¼ thickness region (¼ t region) and the thickness center region (½ t region). Matrix toughness was assessed by sampling an impact test piece from the thickness center region in the direction perpendicular to the rolling direction, in conformity with JIS Z 2202, and determining the fracture appearance transition temperature (vTrs) by a method in conformity with JIS Z 2242. Weld heat-affected zone toughness was ascertained for a steel of a thickness of 32 mm or less at its original thickness and for a steel exceeding a thickness of 32 mm after preparing a plate of reduced thickness. A V-groove butt joint was submerged arc welded at high heat input of 20 kJ/mm, the impact test piece prescribed by JIS Z 2202 was sampled so that the bottom of the notch ran along the fusion line, and heat-affected zone toughness was evaluated from absorbed energy at −20° C. (vE-20). Acoustic anisotropy was ascertained in accordance with Standard NDIS2413-86 of The Japanese Society for Non-Destructive Inspection. Acoustic anisotropy was assessed as small when the sound velocity ratio was 1.02 or less. The desired values of the properties were yield stress: 450 MPa or greater, tensile strength: 570 MPa or greater, vTrs: −20° C. or less, vE-20: 70J or greater, and sound velocity ratio: 1.02 or less. Volume ratios of the matrix structure were calculated by observing 10 fields within a range of 100 mm×100 mm using 500× structure micrographs taken at the thickness center region.

All of Examples 1-A to 20-T exhibited yield stress greater than 450 MPa, tensile strength greater than 570 MPa, weld heat-affected zone toughness vE-20 greater than 200J, and sound velocity ratio of 1.02 or less.

In contrast, yield stress and/or tensile strength was insufficient in Comparative Example 21-U owing to low C, Comparative Example 22-V owing to high C, Comparative Example 25-Y owing to low Mn, Comparative Example 28-AB owing to low Nb, Comparative Example 30-AD owing to low Ti, Comparative Example 32-AF because the value of parameter A (A=([Nb]+2×[Ti])×([C]+[N]×12/14) was less than 0.0022, Comparative Example 33-AG because parameter A was greater than 0.0055, Comparative Example 42-A because the heating temperature was lower than T° C., and Comparative Example 46-A owing to low cooling rate.

Yield stress and tensile strength were insufficient in Comparative Example 47-A owing to high accelerated cooling termination temperature and Comparative Example 48-A owing to low accelerated cooling termination temperature.

Yield stress at the ½ t region was insufficient in Comparative Examples 23-W and 24-X because the island martensite volume ratio was 3% or more owing to high Si content.

Weld heat-affected zone toughness was low in Comparative Example 27-AA owing to high Mo content, Comparative Example 29-AC because Nb+2Ti exceeded 0.105% owing to high Nb content, Comparative Example 31-AE because Nb+2Ti exceeded 0.105% owing to high Ti content, Comparative Example 34-AH owing to low N content, Comparative Example 36-AJ owing to high V content, Comparative Example 37-AK owing to high Cu content, Comparative Example 38-AL owing to high Ni content, Comparative Example 39-AM owing to high Cr content, Comparative Example 40-AN owing to high Mg content, and Comparative Example 41-AO owing to high Ca content.

Matrix toughness was low in Comparative Example 26-Z owing to high Mn content and Comparative Example 35-AI owing to high N content.

Yield stress and/or tensile strength was low in Comparative Example 43-A owing to high total rolling reduction in the temperature range of lower than 1020° C. to higher than 920° C. and Comparative Example 44-A owing to low total rolling reduction in the temperature range of 920° C. to 860° C.

Acoustic anisotropy was high in Comparative Example 45-A because yield stress and tensile strength were low owing to high total rolling reduction in the temperature range of 920° C. to 860° C.

What is claimed is:

1. A high-tensile steel plate having a yield stress of 450 MPa or greater and a tensile strength of 570 MPa or greater at the plate thickness center region and having a plate thickness of 30 to 100 mm, comprising, in mass %:

C: 0.05% to 0.07%,

Si: 0.09% or less,

Mn: 0.8% to 2.0%, and

Al: 0.010% to 0.1%;

comprising Nb and Ti at contents of, in mass %:

Nb: 0.025% or more, and

Ti: 0.005% or more that satisfy $0.045\% \leqq [Nb]+2\times[Ti] \leqq 0.105\%$;

comprising:

N: more than 0.0025 mass % and not more than 0.008 mass %; and comprising Nb, Ti, C and N at contents in ranges such that the value of A shown below is 0.0022 to 0.0055, weld cracking parameter for steel composition Pcm shown below being 0.18 or less, and a balance of Fe and unavoidable impurities; and having a steel structure of bainite or mixture of bainite and ferrite comprising a bainite volume ratio of 30% or more, wherein a pearlite volume ratio is less than 5%, and an island martensite volume ratio is less than 3%:

$$A=([Nb]+2\times[Ti])\times([C]+[N]\times 12/14),$$

$$Pcm=[C]+[Si]/30+[Mn]/20+[Cu]/20+[Ni]/60+[Cr]/20+[Mo]/15+[V]/10+5[B],$$

where [Nb], [Ti], [C], [N], [Si], [Mn], [Cu], [Ni], [Cr], [Mo], [V] and [B] represent the contents of Nb, Ti, C, N, Si, Mn, Cu, Ni, Cr, Mo, V and B expressed in mass %.

2. The high-tensile steel plate according to claim 1, further comprising, any one of, in mass %:

Mo: 0.05% to 0.3%,

Cu: 0.1% to 0.8%,

Ni: 0.1% to 1.0%,

Cr: 0.1% to 0.8%,

V: 0.01% or more to less than 0.03%,

W: 0.1% to 3%,

B: 0.0005% to 0.0050%

Mg: 0.0005% to 0.01%, and

Ca: 0.0005% to 0.01%.

3. The high-tensile steel plate according to claim 1, wherein said steel contains, in mass %:

Si: 0.07% or less.

4. The high-tensile steel plate according to claim 2, wherein said steel contains, in mass %:

Si: 0.07% or less.

5. The high-tensile steel plate according to claim 1, wherein the steel plate has a sound velocity ratio of 1.02 or less.

6. The high-tensile steel plate according to claim 2, wherein the steel plate has a sound velocity ratio of 1.02 or less.

7. The high-tensile steel plate according to claim 1, wherein the steel structure has a bainite volume ratio of 68% or more.

8. The high-tensile steel plate according to claim 2, wherein the steel structure has a bainite volume ratio of 68% or more.

* * * * *

UNITED STATES PATENT AND TRADEMARK OFFICE

CERTIFICATE OF CORRECTION

PATENT NO. : 8,246,768 B2
APPLICATION NO. : 12/084502
DATED : August 21, 2012
INVENTOR(S) : Manabu Hoshino et al.

It is certified that error appears in the above-identified patent and that said Letters Patent is hereby corrected as shown below:

In the Specification

Column 11, line 48, change “thickness center region” to -- thickness center region. --;

Column 12, line 20, change “defined, i.e.;” to -- defined, i.e., --;

Column 13, line 21, change “toughness;” to -- toughness, --;

Column 13, line 51, change “sulfides and or” to -- sulfides and/or --.

Signed and Sealed this
Tenth Day of December, 2013

Margaret A. Focarino

Margaret A. Focarino
*Commissioner for Patents of the United States Patent and Trademark Office*